US009836008B2

(12) United States Patent
Yuasa

(10) Patent No.: US 9,836,008 B2
(45) Date of Patent: Dec. 5, 2017

(54) IMAGE FORMING APPARATUS

(71) Applicant: FUJI XEROX CO., LTD., Tokyo (JP)

(72) Inventor: Koichiro Yuasa, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/246,715

(22) Filed: Aug. 25, 2016

(65) Prior Publication Data

US 2017/0255139 A1 Sep. 7, 2017

(30) Foreign Application Priority Data

Mar. 7, 2016 (JP) ..... 2016-043509

(51) Int. Cl.
*G03G 15/00* (2006.01)
*G03G 15/20* (2006.01)
*G03G 15/01* (2006.01)

(52) U.S. Cl.
CPC ..... *G03G 15/6585* (2013.01); *G03G 15/01* (2013.01); *G03G 15/2039* (2013.01)

(58) Field of Classification Search
None
See application file for complete search history.

(56) References Cited

U.S. PATENT DOCUMENTS

2011/0236102 A1* 9/2011 Furushige ..... G03G 15/6576 399/406
2014/0043623 A1* 2/2014 Koyatsu ..... G03G 15/6585 358/1.1
2014/0147148 A1* 5/2014 Kiuchi ..... G03G 15/2046 399/67
2014/0356008 A1* 12/2014 Harashima ..... G03G 13/20 399/69

FOREIGN PATENT DOCUMENTS

JP 4820110 B2 11/2011

* cited by examiner

*Primary Examiner* — Thomas Giampaolo, II
(74) *Attorney, Agent, or Firm* — Oliff PLC

(57) ABSTRACT

An image forming apparatus includes: an image forming unit that includes a developing device which performs development with a toner having a metal color which contains a flat metal pigment and a developing device which performs development with a toner having another color other than the metal color which does not contains a flat metal pigment, and forms a toner image on a recording medium; a fixing unit that fixes the toner image formed on the recording medium; and a controller that controls the image forming unit and the fixing unit such that a toner image is formed of the toner having the metal color and fixed on one surface of a film, and controls transport of the film as defined herein.

14 Claims, 9 Drawing Sheets

IMAGE FORMING APPARATUS

CROSS-REFERENCE TO RELATED APPLICATIONS

This application is based on and claims priority under 35 USC 119 from Japanese Patent Application No. 2016-043509 filed Mar. 7, 2016.

BACKGROUND

Technical Field

The present invention relates to an image forming apparatus.

SUMMARY

According to an aspect of the invention, there is provided an image forming apparatus including: an image forming unit that includes a developing device which performs development with a toner having a metal color which contains a flat metal pigment and a developing device which performs development with a toner having another color other than the metal color which does not contains the flat metal pigment, and forms a toner image on a recording medium; a fixing unit that fixes the toner image formed on the recording medium; and a controller that controls the image forming unit and the fixing unit such that a toner image is formed of the toner having the metal color and fixed on one surface of a film, and controls transport of the film such that the film in which the toner image is fixed on the one surface is output, or the film in which the toner image is fixed on the one surface has a front surface and a back surface reversed to each other so as to be supplied to the image forming unit, in a case where the film is selected as the recording medium and a metal glossiness improving mode is selected so as to improve metal glossiness.

BRIEF DESCRIPTION OF THE DRAWINGS

Exemplary embodiments of the present invention will be described in detail based on the following figures, wherein:

FIGS. 3A and 3B are schematic diagrams illustrating an example of a shape of a flat metal pigment, of which FIG. 3A is a plan view and FIG. 3B is a side view;

DETAILED DESCRIPTION

Hereinafter, an example of the exemplary embodiment of the invention will be described with reference to the drawings.

<Image Forming Apparatus>

Figure 1:
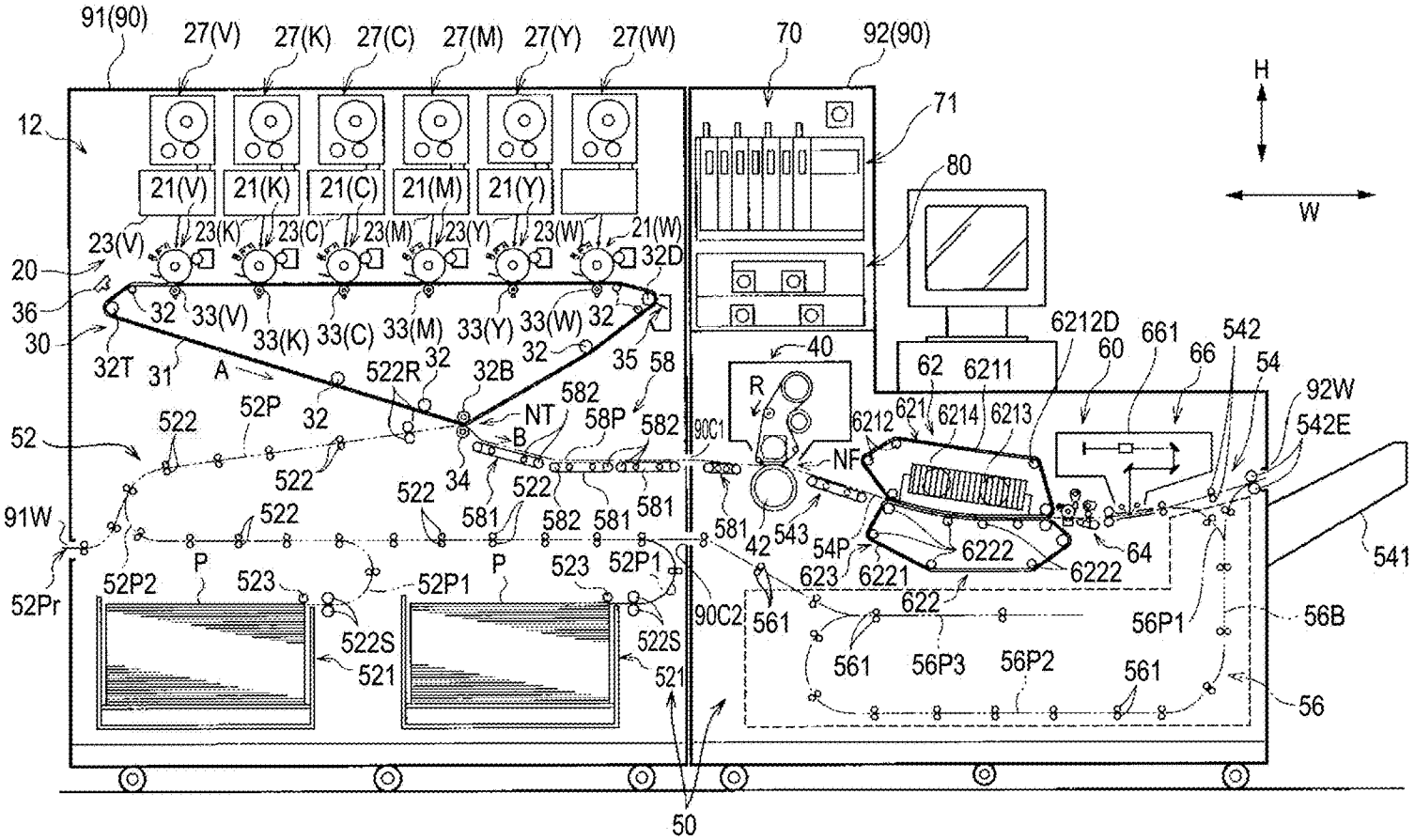
FIG. 1 is a schematic configuration diagram illustrating an example of a configuration of an image forming apparatus according to the exemplary embodiment of the invention.
Figure 2:
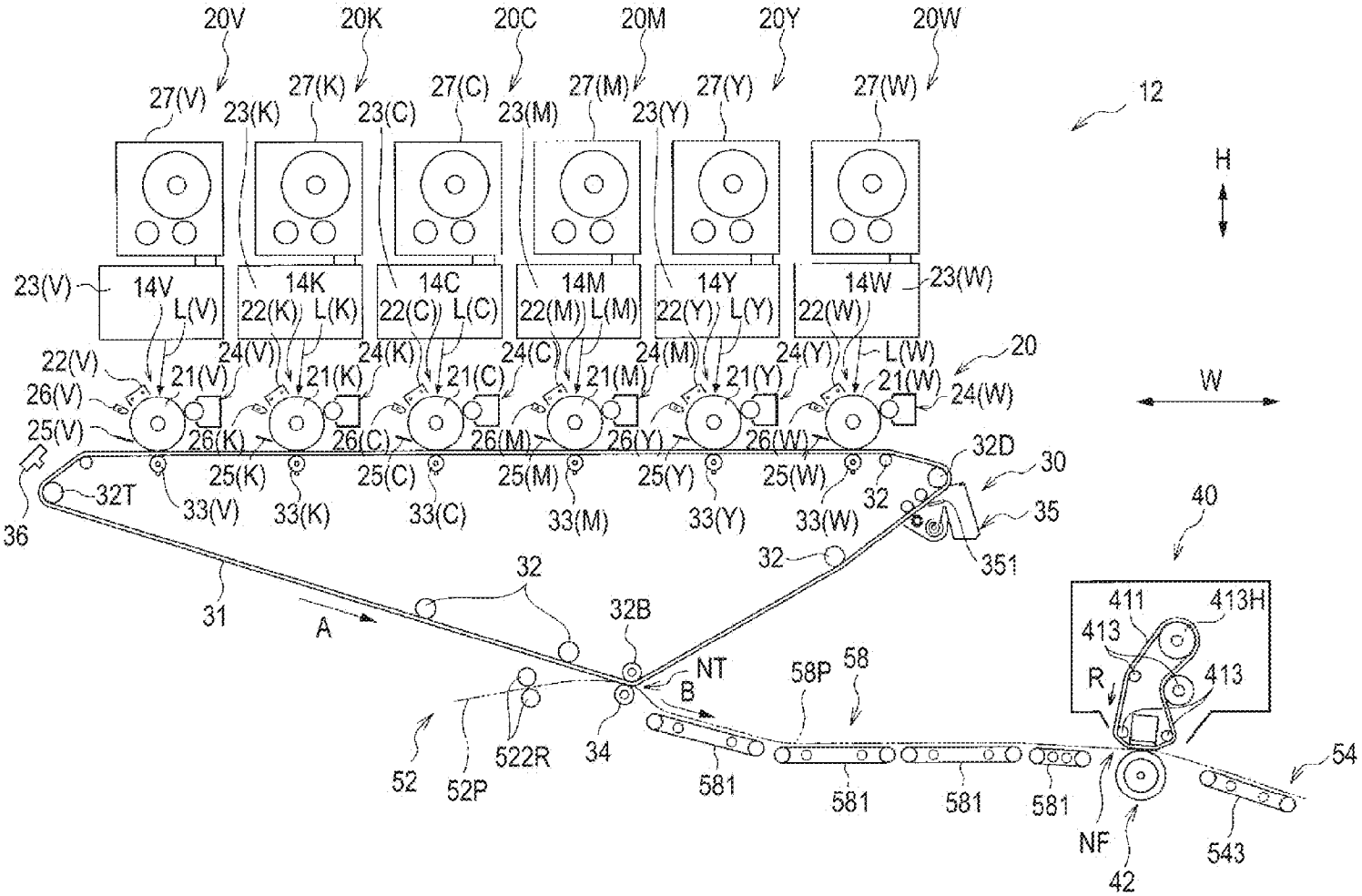
FIG. 2 is a schematic configuration diagram illustrating a configuration of an image forming device (a main component) of the image forming apparatus illustrated in FIG. 1.

First, the image forming apparatus will be described. FIG. 1 is a schematic configuration diagram illustrating an example of a configuration of the image forming apparatus according to the exemplary embodiment of the invention. FIG. 2 is a schematic configuration diagram illustrating a configuration of the image forming device (main component) of the image forming apparatus illustrated in FIG. 1. Note that, in the drawings, an arrow H represents a vertical direction, and an arrow W represents a horizontal direction, which is width direction of the apparatus.

As illustrated in FIG. 1, an image forming apparatus 10 is provided with an image forming device 12 that forms an image on a recording medium P as a recording medium by an electrophotographic process, a medium transport unit 50 that transports the recording medium P, and a post-processing unit 60 that performs a post process on the recording medium P on which the image is formed. In addition, the image forming apparatus 10 is provided with a power supply unit 80 that supplies power to the respective units of the apparatus, and a controller 70 that controls the respective units of the apparatus.

The image forming device 12 is provided with a toner image forming unit 20 that forms a toner image, a transfer unit 30 that transfers the toner image formed by the toner image forming unit 20 to the recording medium P, and a fixing unit 40 that fixes the toner image transferred to the recording medium P on the recording medium P.

The medium transport unit 50 is provided with a medium supply unit 52 that supplies the recording medium P to the image forming device 12, and a medium exit unit 54 that exits the recording medium P on which the toner image is formed. In addition, the medium transport unit 50 is provided with a medium returning unit 56 and an intermediate transport unit 58 which are used at the time of forming images on both surfaces of the recording medium P.

The post-processing unit 60 is provided with a medium cooling unit 62 that cools the recording medium P to which the toner image is transferred by the image forming device 12, a correcting device 64 that corrects a curve of the recording medium P, and an image inspecting unit 66 that inspects the image formed on the recording medium P. The respective components constituting the post-processing unit 60 are disposed in the medium exit unit 54 of the medium transport unit 50.

The components of the image forming apparatus 10 are accommodated in a housing 90 except for an exit medium receiving portion 541. The housing 90 in the exemplary embodiment is divided into a first housing 91 and a second housing 92 which are adjacent to each other in the width direction of the apparatus. With this, a transporting unit of the image forming apparatus 10 is miniaturized in the width direction of the apparatus.

The first housing 91 accommodates main components of the image forming device 12 except for the fixing unit 40 and the medium supply unit 52. The second housing 92 accommodates the fixing unit 40, the medium exit unit 54, the medium cooling unit 62, the image inspecting unit 66, the medium returning unit 56, the controller 70, and the power supply unit 80 which constitute the image forming device 12.

The first housing 91 and the second housing 92 are coupled to each other by a fastening tool such as a bolt and nut (not shown as one example of components). A communication opening portion 90C1 through which the recording medium P passes from a transfer nip NT of the image forming device 12 to a fixing nip NF, and a communication path 90C2 through which the recording medium P passes from the medium returning unit 56 to the medium supply unit 52 are formed between the first housing 91 and the second housing 92 in a coupled state.

(Image Forming Unit)

Hereinafter, the "image forming unit" will be described.

The image forming device 12 is provided with the toner image forming unit 20, the transfer unit 30, and the fixing unit 40. In the exemplary embodiment, toner image forming units 20V, 20W, 20Y, 20M, 20C, and 20K that form a toner image are correspondingly provided for each of the colors such as a first spot color (V), a second spot color (W), yellow (Y), magenta (M), cyan (C), and black (K).

The toner image forming units 20V, 20W, 20Y, 20M, 20C, and 20K are arranged in order of 20W→20Y→20M→20C→20K→20V of the toner image forming units along the upper side portion of the transfer belt 31 from the upstream side in the moving direction of the transfer belt 31. That is, the toner images are formed on the transfer belt 31 in order of a W color image→a Y color image→a M color image→a C color image→a K color image→a V color image.

In addition, in the exemplary embodiment, the first spot color (V) is "a silver color" or "a gold color", and the toner image forming unit 20V forms a toner image by a toner having a metal color containing a flat metal pigment. The toner having the metal color is used to impart metal glossiness to an image. On the other hand, the second spot color (W) is a user's unique corporate color which is frequently used as compared with other colors. Note that, details of the toner having the metal color, and the control of the components which is performed by the controller 70 at the time of forming an image by using the toner having the metal color will be described below.

Each of the toner image forming units 20V, 20W, 20Y, 20M, 20C, and 20K is formed in a similar way. If there is no need to distinguish the aforementioned units for each color, it is referred to as a toner image forming unit 20. The toner image forming unit 20 is provided with an image forming unit 14, and a toner cartridge 27 which holds toner, as illustrated in FIG. 2. The image forming unit 14 provided for each color will be described without being distinguished for each color. The image forming unit 14 is provided with a photoconductor drum 21 which is an example of the image carrier, a charging unit 22, an exposure unit 23, a developing unit 24 which is an example of a developing device, a cleaning unit 25, and a charge eliminating unit 26.

A photoreceptor layer is formed on the surface of the photoconductor drum 21. The charging unit 22 causes a surface (the photoreceptor layer) of the photoconductor drum 21 to be charged through a corona discharge process. The exposure unit 23 irradiates the surface of the photoconductor drum 21 which is charged by the charging unit 22 with exposure light L so as to form an electrostatic latent image on the surface of the photoconductor drum 21. The exposure light L is modulated in response to image data obtained from an image signal processing portion 71 (refer to FIG. 1) of the controller 70. The developing unit 24 develops an electrostatic latent image formed on the surface of the photoconductor drum 21 by using a developer G containing toner so as to form a toner image on the surface of the photoconductor drum 21.

The cleaning unit 25 is formed into a blade shape, and scrapes the toner remaining on the surface of the photoconductor drum 21 after transferring the toner image to the transfer unit 30 from the surface of the photoconductor drum 21. The charge eliminating unit 26 eliminates a charge by irradiating the transferred photoconductor drum 21 with light. With this, a charging history of the surface of the photoconductor drum 21 is canceled. The toner cartridge 27 supplies toner to the developing unit 24.

The transfer unit 30 primarily transfers the toner image of the photoconductor drum 21 for each color which is superimposed on the transfer belt 31, and then secondarily transfers the superimposed toner image to the recording medium P. Hereinafter, the details will be described.

The transfer belt 31 is an endless belt type as illustrated in FIG. 2, and is wound around plural rollers 32. A roller 32D serves as a driving roller which causes the transfer belt 31 to be rotated by a driving force of a motor (not shown) in an arrow A direction. In addition, a roller 32T serves as a tensioning roller which imparts tension to the transfer belt 31. A peak portion on the lower end side which forms an obtuse angle of the transfer belt 31 is wound around a roller 32B. The roller 32B serves as a facing roller of a secondary transfer roller 34 which is described below. The transfer belt 31 comes in contact with the lower side of the photoconductor drum 21 for each color in the upper side portion extending in the width direction of the apparatus.

A primary transfer roller 33 which is an example of a transfer member for transferring the toner images in the photoconductor drums 21 to the transfer belt 31 is disposed on the inside of the transfer belt 31. Each of the primary transfer rollers 33 is disposed so as to face the photoconductor drum 21 in the corresponding color with the transfer belt 31 interposed therebetween. In addition, a transfer bias voltage having polarity which is opposite to the toner polarity is applied to the primary transfer roller 33. By applying such a transfer bias voltage to the primary transfer roller 33, the toner image formed on the photoconductor drum 21 is transferred to the transfer belt 31.

In addition, the transfer unit 30 is provided with a secondary transfer roller 34 for transferring the toner image which is superimposed on the transfer belt 31 to the recording medium P. The secondary transfer roller 34 is disposed between the rollers 32B with the transfer belt 31 interposed therebetween, and has the transfer nip NT formed between the secondary transfer roller 34 and the transfer belt 31. The recording medium P is supplied to the aforementioned transfer nip NT from the medium supply unit 52 in a timely manner. A transfer bias voltage which is opposite to the toner polarity is applied to the secondary transfer roller 34 by a feeding portion (not shown). By applying the transfer bias voltage to the secondary transfer roller 34, the toner image is transferred to the recording medium P passing through the transfer nip NT from the transfer belt 31.

Further, the transfer unit 30 is provided with a cleaning unit 35 that cleans the transfer belt 31 after performing the secondary transfer. The cleaning unit 35 is disposed on the downstream side of a portion (transfer nip NT) in which the secondary transfer is performed, and the upstream side of a portion in which the primary transfer is performed in the circumference direction of the transfer belt 31. The cleaning unit 35 is provided with a blade 351 for scrapping the toner remaining on the surface of the transfer belt 31.

The fixing unit 40 fixes the toner image on the recording medium P to which the toner image is transferred in the transfer unit 30. In the exemplary embodiment, the fixing unit 40 fixes the toner image to the recording medium P by heating and pressurizing the toner image in the fixing nip NF which is formed by the fixing belt 411 which is wound around plural rollers 413, and the pressure roller 42.

A roller 413H is set as a heating roller which is provided with a heater therein and is rotated by a driving force transferred from a motor (not shown). With this, the fixing belt 411 is rotated in an arrow R direction. In addition, the pressure roller 42 is also rotated at the same circumferential speed as that of the fixing belt 411 by the driving force transferred from the motor (not shown). A fixing temperature and the like of the fixing unit 40 which are controlled by the controller 70 will be described below.

(Medium Transport Unit)

Here, the "medium transport unit" will be described in detail.

The medium transport unit 50 includes the medium supply unit 52, the medium exit unit 54, the medium returning unit 56, and the intermediate transport unit 58.

The medium supply unit 52 is provided with a container 521 accommodating the recording mediums P in a state of being stacked. In the exemplary embodiment, two containers 521 are disposed side by side in the width direction of the apparatus, on the lower side of the transfer unit 30. A medium supply path 52P is formed from each of the containers 521 to the transfer nip NT which is a portion for the secondary transfer by plural pairs of the transport roller pair 522.

A feeding roller 523 for feeding the top of the recording medium P stacked on the container 521 is disposed on the upper side of each of the containers 521. Among the plural pairs of the transport roller pair 522, pairs of the transport roller pair 522S on the most upstream side in the transport direction of the recording medium P serve as a separation roller which separates the recording media P, which are stacked by the feeding roller 523 and are fed from the container 521, one by one. In addition, among the plural pairs of the transport roller pair 522, pairs of the transport roller pair 522R positioned on the right upstream side of transfer nip NT in the transport direction of the recording medium P are operated such that moving timing of the toner image on the transfer belt 31 and transporting timing of the recording medium P are matched with each other.

In addition, the medium supply unit 52 is provided with a preliminary transporting path 52Pr. The preliminary transporting path 52Pr is started from an opening portion 91W on the side opposite to the second housing 92 side of the first housing 91, and joins a turning-back portion 52P2 of the medium supply path 52P. The preliminary transporting path 52Pr is set as a transporting path at the time of sending the recording medium P which is fed from an optional recording medium supply device (not shown) disposed to be adjacent to the opening portion 91W side of the first housing 91 to the image forming device 12.

The intermediate transport unit 58 is disposed between the transfer nip NT of the transfer unit 30 and the fixing nip NF of the fixing unit 40, and is provided with plural belt transporting members 581 including an endless transport belt which is wound around the roller. The belt transporting member 581 is configured such that the transport belt is rotated with the recording medium P being sucked onto the surface of the transport belt by suctioning air (negative pressure suction) from the inside so as to transport the recording medium P.

The medium exit unit 54 exits the recording medium P on which the toner image is fixed by the fixing unit 40 of the image forming device 12 to the outside of the housing 90 from the exit port 92W of the second housing 92 which is formed at an end portion on the side opposite to the first housing 91 side. The medium exit unit 54 is provided with the exit medium receiving portion 541 for receiving the recording medium P output from the exit port 92W.

The medium exit unit 54 includes a medium exit path 54P for which the recording medium P is transported to the exit port 92W from the fixing unit 40 (fixing nip NF). The medium exit path 54P is formed by a belt transporting member 543, and the plural pairs of rollers 542. In addition, among the plural pairs of rollers 542, a pair of rollers 542E disposed on the most downstream side in the output direction of the recording medium P serve as exit rollers for outputting the recording medium P onto the output medium receiving portion 541.

The medium returning unit 56 is provided with plural pairs of rollers 561. The plural pairs of rollers 561 form a reverse path 56P, into which the recording medium P having passed through the image inspecting unit 66 is fed, in a case where an image is to be formed on both sides of the recording medium. The reverse path 56P includes a branch path 56P1, a transport path 56P2, and a reverse path 56P3. The branch path 56P1 is branched from the medium exit path 54P. The transport path 56P2 allows the recording medium P received from the branch path 56P1 to be fed into the medium supply path 52P. The reverse path 56P3 is provided in the middle of the transport path 56P2, allows the transport path 56P2 to be turned back (switched back) in the direction opposite to the direction in which the recording medium P is transported, and reverses the front surface and the back surface.

(Post-Processing Unit)

The medium cooling unit 62, the correcting device 64, and the image inspecting unit 66 which constitute the post-processing unit 60 are sequentially disposed, from the upstream side in the output direction, on the upstream side in the output direction of the recording medium P with respect to a portion where the branch path 56P1 is branched on the medium output path 54P of the medium output unit 54.

The medium cooling unit 62 is provided with an endothermic unit 621 for absorbing heat of the recording medium P and a pressing unit 622 for pressing the recording medium P to the endothermic unit 621. The endothermic unit 621 is disposed on the upper side of the medium exit path 54P, and the pressing unit 622 is disposed on the lower side of the medium exit path 54P.

The endothermic unit 621 is provided with an endless endothermic belt 6211, plural rollers 6212 for supporting the endothermic belt 6211, a heat sink 6213 disposed in the inside of the endothermic belt 6211, and a fan 6214 for cooling the heat sink 6213. The endothermic belt 6211 comes in contact with the recording medium P on the outer circumferential surface so as to exchange the heat. Among the plural rollers 6212, a roller 6212D serves as a driving roller for transferring a driving force to the endothermic belt 6211. The heat sink 6213 is in surface-contact with the inner circumferential surface of the endothermic belt 6211 in a predetermined range so as to be slidable along the medium exit path 54P.

The pressing unit 622 is provided with an endless pressing belt 6221 and plural rollers 6222 for supporting the pressing belt 6221. The pressing belt 6221 is wound around the plural rollers 6222. The pressing unit 622 presses the recording medium P to the endothermic belt 6211 (heat sink 6213) so as to transport the recording medium P together with the endothermic belt 6211.

The correcting device 64 is provided on the downstream side of the medium cooling unit 62 in the medium exit unit 54. The correcting device 64 corrects a curve (curl) of the recording medium P received from the medium cooling unit 62. In addition, an in-line sensor 661 which constitutes the main component of the image inspecting unit 66 is disposed on the downstream side of the correcting device 64 in the medium exit unit 54. The in-line sensor 661 detects existence or the degree of a toner concentration defect, an image defect, an image position defect, and the like of the fixed toner image, based on the light, with which the recording medium P is irradiated, reflected on the recording medium P.

<Image Forming Operation (Action)>

Next, an image forming step and a post-processing step which are to be performed on the recording medium P by the image forming apparatus 10 will be described. The image forming step is performed based on a user's selection and various image forming conditions set in advance. In the exemplary embodiment, in the image forming step, a "normal mode" in which an image is formed in normal procedure, and a "metal glossiness improving mode" in which an image is formed in procedure of imparting high metal glossiness are prepared.

In addition, it is possible to select a type of the recording medium P (for example, a container accommodating a film), and in a case where a transparent film is selected as the recording medium P, it is possible to select the "metal glossiness improving mode". Here, the expression of "transparent" means that the light is not absorbed in the visible region. In the following description, a "transparent film" is simply referred to as a "film".

In the "metal glossiness improving mode", there are additional options such as a "one surface having the metal color", a "both surfaces having the metal color", and a "back surface having the metal color". The aforementioned options will be described in detail. The image signal processing portion 71 (refer to FIG. 1) of the controller 70 performs an image forming command by obtaining image data and selection setting information of the image data or the like as "image forming information".

(Toner Having Metal Color)

Figure 3A:
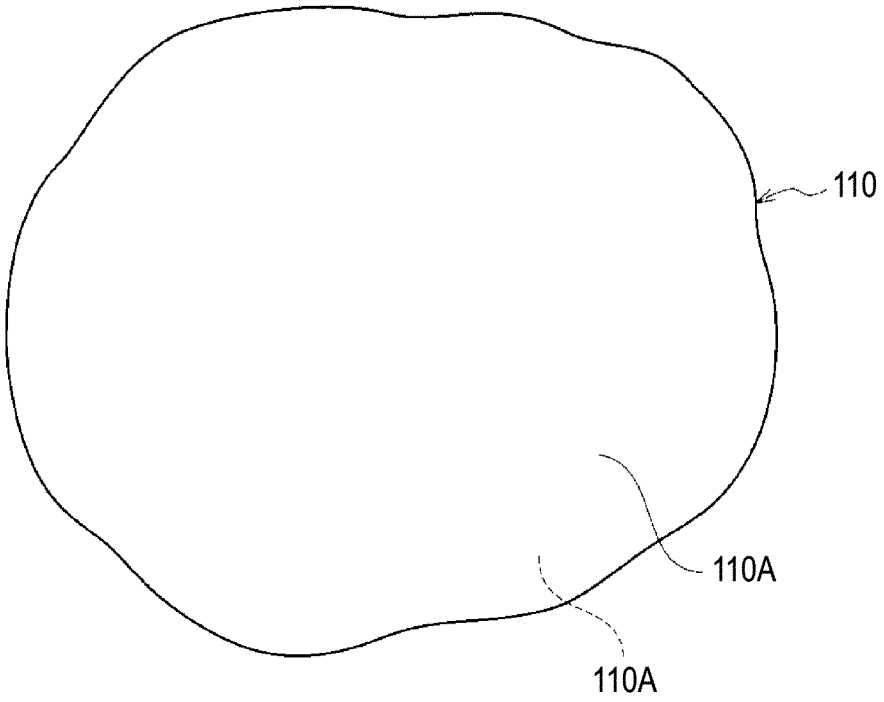
Figure 3B:
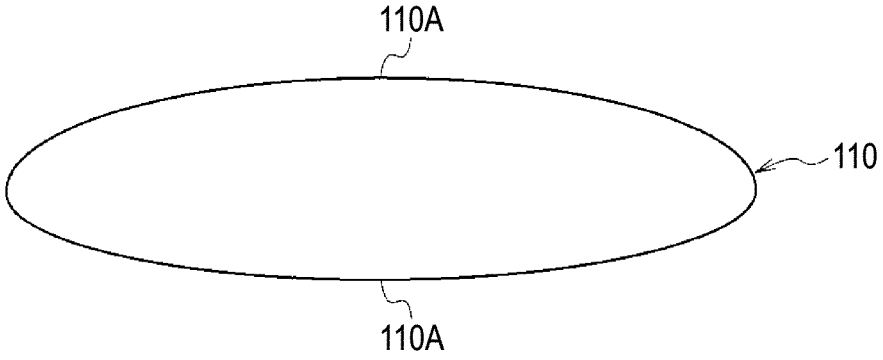

Hereinafter, the "toner having the metal color" will be described. FIGS. 3A and 3B are schematic diagrams illustrating an example of a shape of a flat metal pigment. The toner having a metal color, such as a silver color, a gold color, or the like which is used as the first spot color (V), contains a metal pigment and a binder resin, and is used to impart the metal glossiness to the image. The metal pigment is formed of aluminum or the like. As illustrated in FIG. 3B, the metal pigment 110 is formed into a long rod shape extending in the horizontal direction when viewed from the side on a plane in the drawing.

In addition, when the metal pigment 110 illustrated in FIG. 3B is viewed from above in the drawing, the shape of the metal pigment 110 is wider than the shape when viewed from the side as illustrated in FIG. 3A. That is, the metal pigment 110 is placed on the plane, and includes a pair of reflecting surfaces 110A (flat surfaces) which face the upper side and the lower side. As such, the metal pigment 110 is formed into a flat shape. Hereinafter, the metal pigment formed into the flat shape is referred to as a "flat metal pigment 110".

On the other hand, a toner having a certain color except for the metal color (hereinafter, simply referred to as a "toner having a certain color"), which is used as a second spot color (W), a yellow (Y), a magenta (M), a cyan (C), and a black (K) is formed of a pigment which does not contain a flat metal pigment (for example, an organic pigment or an inorganic pigment) and a binder resin.

Figure 4A:
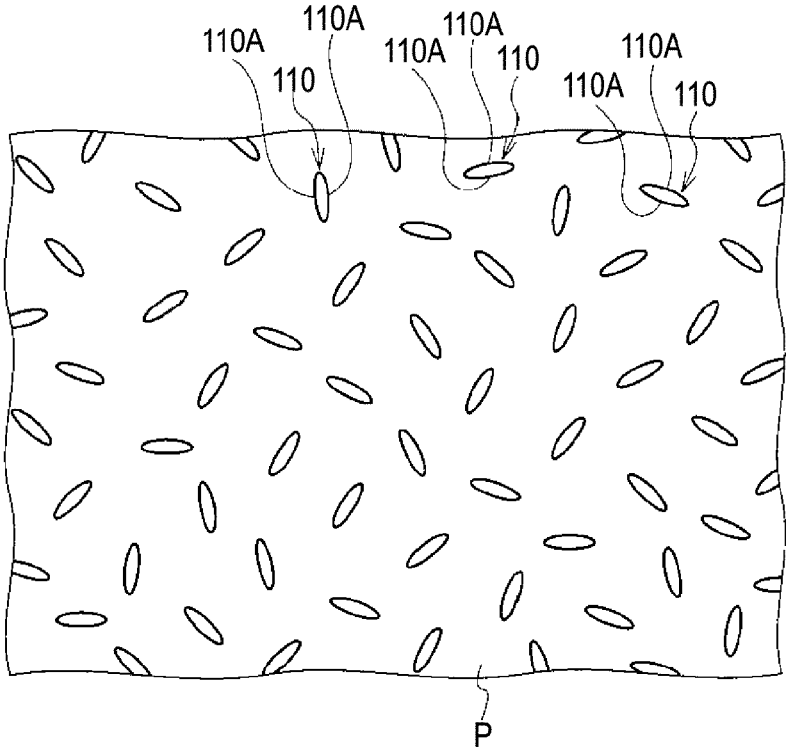
FIGS. 4A and 4B are schematic diagrams illustrating an example of a posture of the flat metal pigment.
Figure 4B:
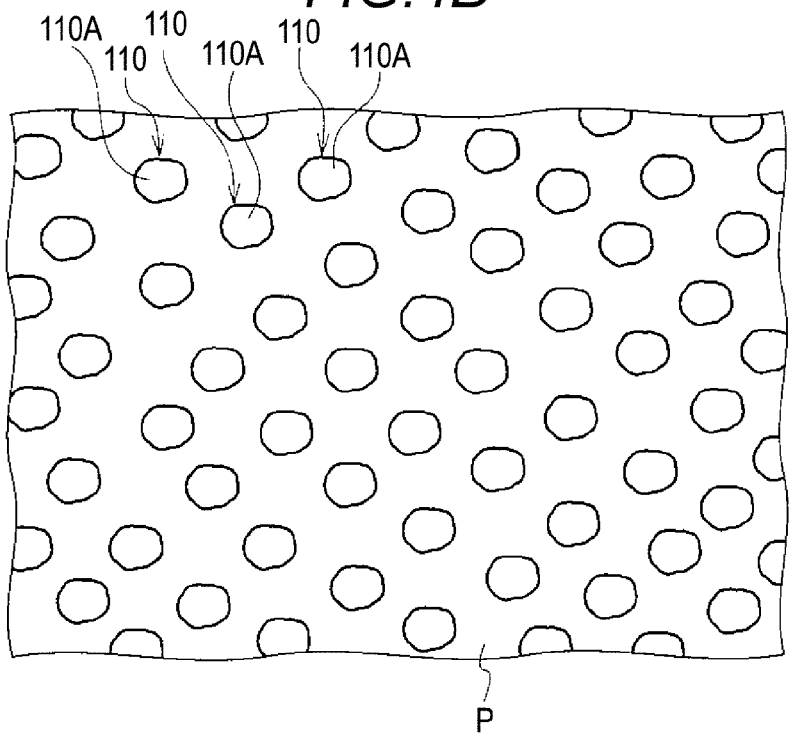

Next, the relationship between the improvement of the metal glossiness and the posture of the flat metal pigment will be described. FIGS. 4A and 4B are schematic diagrams illustrating an example of the posture of the flat metal pigment. As illustrated in FIG. 4A, in a case where the direction facing the reflecting surface 110A of the flat metal pigment 110 is not constant, the light reflected on the image is diffused. In contrast, as illustrated in FIG. 4B, the reflecting surface 110A of the flat metal pigment 110 faces the direction orthogonal to the surface of the recording medium P, and the flat metal pigments 110 are arranged in the direction along the surface of the recording medium P, and thus it is possible to prevent the light reflected on the image from being diffused as compared with the case of being illustrated in FIG. 4A. That is, the orientation of the flat metal pigment is improved, and thus the metal glossiness of the image is also improved.

In addition, as illustrated in FIG. 4B, the flat metal pigments 110 of which the reflecting surface 110A faces the direction orthogonal to the surface of the recording medium P are uniformly arranged on the recording medium P, and thus a coverage ratio which is a ratio obtained by covering the recording medium P with the flat metal pigments 110 is improved, as compared with the case of being illustrated in FIG. 4A. A reflective area in which the light incident on the surface of the recording medium P is reflected by the flat metal pigments 110 becomes larger. That is, when the orientation of the flat metal pigment is improved, the coverage ratio by the flat metal pigments is also improved, and thus the metal glossiness of the image is improved.

Particularly, in a case where the recording medium P is a transparent film, the orientation and the coverage ratio of the flat metal pigment 110 are improved, and thus there is no gap between the flat metal pigments 110 through which the light transmits. For this reason, the improvement degree of the metal glossiness of the image is large as compared with the case where the recording medium P is an opaque plain paper. In this regard, in the exemplary embodiment, in a case where the transparent film is selected as the recording medium P, it is possible to select "metal glossiness improving mode". Even in a case where the transparent film is selected as the recording medium P, the user may select the normal mode.

(Normal Mode)

An image forming step and a post-processing step in the "normal mode" will be described with reference to FIG. 1 and FIG. 2. The controller 70 which receives the image forming command in the "normal mode" operates the toner image forming unit 20, the transfer unit 30, the fixing unit 40, the medium transport unit 50, the post-processing unit 60, and the like. For example, the photoconductor drum 21 of the image forming unit 14 for each color, and a developing roller 242 of the developing unit 24 are rotated such that the transfer belt 31 is circulated. In addition, when the pressure roller 42 is rotated, the fixing belt 411 is circulated.

First, a toner image having a color corresponding to any one of the first spot color (V), the second spot color (W), yellow (Y), magenta (M), cyan (C), and black (K) is formed on the photoconductor drum 21 for each color. Specifically, the photoconductor drum 21 is charged by the charging unit 22, and is exposed to exposure light L in response to the image data of the corresponding color by the exposure unit 23, and thereby an electrostatic latent image is formed on the surface of the photoconductor drum 21. The electrostatic latent image which is formed on the photoconductor drum 21 is developed by using a developer of the corresponding color supplied from the developing unit 24. With this, the toner image having the corresponding color is formed on the photoconductor drum 21 for each color.

The toner image for each color which is formed on the photoconductor drum 21 for each color is sequentially transferred to the circulating transfer belt 31 through the applying of a transfer bias voltage through the primary transfer roller 33 for each color. With this, a superimposed toner image obtained by superimposing six colors of toner images is formed on the transfer belt 31. In the exemplary embodiment, the six colors of toner images are superimposed in order of a W color image, a Y color image, an M color image, a C color image, a K color image, and a V color image from the transfer belt 31 side. The superimposed toner image is transported to the transfer nip NT by the circulation of the transfer belt 31.

The recording medium P is supplied to the transfer nip NT by pairs of the transport roller pair 522R of the medium supply unit 52 in accordance with the timing of the transporting the superimposed toner image. When the transfer bias voltage is applied to the transfer nip NT, the superimposed toner image is transferred to the recording medium P from the transfer belt 31. After performing the transfer, the six colors of toner images are superimposed in order of the V color image, the K color image, the C color image, the M color image, the Y color image, and the W color image from the recording medium P.

The recording medium P to which the superimposed toner image is transferred is transported to the fixing nip NF of the fixing unit 40 by the intermediate transport unit 58. The fixing unit 40 imparts heat and pressure to the recording medium P passing through the fixing nip NF. With this, the toner image is transferred to and fixed on the recording medium P.

The recording medium P which is output from the fixing unit 40 is processed by the post-processing unit 60 while being transported to the exit medium receiving portion 541 outside the apparatus by the medium exit unit 54. First, the recording medium P heated in a fixing step is cooled in the medium cooling unit 62. Then, the curve of the recording medium P is corrected by the correcting device 64. Further, regarding the toner image fixed on the recording medium P, the existence or the degree of a toner concentration defect, an image defect, an image position defect, and the like are detected by the image inspecting unit 66. In addition, the recording medium P is output to the medium exit unit 54.

On the other hand, in a case where an image is formed on a non-image surface which is one surface of the recording medium P on which an image is not formed (a case of duplex printing), the controller 70 switches a transporting path of the recording medium P after passing through the image inspecting unit 66 into the branch path 56P1 of the medium returning unit 56 from the medium exit path 54P of the medium exit unit 54. With this, the recording medium P having the front surface and the back surface reversed to each other via the reverse path 56P is fed into the medium supply path 52P. An image is formed (fixed) on the back surface of the recording medium P in the same step as that of forming the image on the front surface as described above. The recording medium P goes through the same step as the above-described processing step performed after forming the image on the front surface, and then is output to the exit medium receiving portion 541 outside the apparatus by the medium exit unit 54.

(Metal Glossiness Improving Mode (Back Surface Having Metal Color))

An image forming step in the "metal glossiness improving mode (back surface having metal color)" will be described with reference to FIG. 1 and FIG. 2. The post-processing step is the same as that in the normal mode, and thus the description thereof will not be described below. In the "metal glossiness improving mode", it is assumed that the recording medium P is a film, the recording medium P is referred to as a "film F". Similar to the case of the normal mode, the controller 70 which receives the image forming command in the "metal glossiness improving mode (back surface having metal color)" operates the toner image forming unit 20, the transfer unit 30, the fixing unit 40, the medium transport unit 50, the post-processing unit 60, and the like.

First, a solid image having an image density (Cin) of 100% is formed of the toner having the metal color which is the first spot color (V) on the photoconductor drum 21V. The solid image is formed on the entire image forming region of the back surface of the film F (hereinafter, referred to as "the entire back surface"). Note that, in the exemplary embodiment, an example in which the toner image having the metal color is formed on the entire back surface will be described; however, the toner image having the metal color may be formed on a portion of the image forming region. The toner image having the metal color which is formed on the photoconductor drum 21V having the metal color is transferred to the circulating transfer belt 31 through the applying of a transfer bias voltage through a primary transfer roller 33V having the metal color. With this, the toner image having the metal color is formed on the transfer belt 31.

The toner image having the metal color is transported to the transfer nip NT by the circulation of the transfer belt 31. The film F is supplied to the transfer nip NT by pairs of the transport roller pair 522R of the medium supply unit 52 in accordance with the timing of the transporting the toner image. When the transfer bias voltage is applied to the transfer nip NT, the toner image having the metal color is transferred to the back surface of the film F from the transfer belt 31.

The film F to which the toner image having the metal color is transferred is transported to the fixing nip NF of the fixing unit 40 by the intermediate transport unit 58. The fixing unit 40 imparts heat and pressure to the film F passing through the fixing nip NF. With this, the toner image is transferred to and fixed on the back surface of the film F. The film F which is output from the fixing unit 40 is processed by the post-processing unit 60.

The controller 70 switches a transporting path of the film F after passing through the image inspecting unit 66 of the post-processing unit 60 into the branch path 56P1 of the medium returning unit 56 from the medium exit path 54P of the medium exit unit 54. With this, the film F in which the toner image having the metal color is formed on the entire back surface has the front surface and the back surface reversed to each other via the reverse path 56P, and then is fed into the medium supply path 52P.

Next, a toner image having a color corresponding to any one of the first spot color (V), the second spot color (W), yellow (Y), magenta (M), cyan (C), and black (K) is formed on the photoconductor drum 21 for each color. The toner image for each color which is formed on the photoconductor drum 21 for each color is sequentially transferred to the circulating transfer belt 31 through the applying of a transfer bias voltage through the primary transfer roller 33 for each color. With this, a superimposed toner image obtained by superimposing five colors of toner images is formed on the transfer belt 31. In the exemplary embodiment, the five colors of toner images are superimposed in order of the W color image, the Y color image, the M color image, the C color image, and the K color image from the transfer belt 31 side.

The superimposed toner image is transported to the transfer nip NT by the circulation of the transfer belt 31. The film F in which the toner image having the metal color is formed on the entire back surface is supplied to the transfer nip NT by pairs of the transport roller pair 522R of the medium supply unit 52 in accordance with the timing of the transporting the toner image. When the transfer bias voltage is applied to the transfer nip NT, the superimposed toner image is transferred to the front surface of the film F from the transfer belt 31. After performing the transfer, the five colors of toner images are superimposed in order of the K color image, the C color image, the M color image, the Y color image, and the W color image from the film F side.

The film F to which the superimposed toner image is transferred is transported to the fixing nip NF of the fixing unit 40 by the intermediate transport unit 58. The fixing unit 40 imparts heat and pressure to the film F passing through the fixing nip NF. With this, the toner image is transferred to and fixed on the front surface of the film F. The film F which is output from the fixing unit 40 is processed by the post-processing unit 60 while being transported to the exit medium receiving portion 541 outside the apparatus by the medium exit unit 54. The film F processed by the post-processing unit 60 is output to the exit medium receiving portion 541 outside of the apparatus by the medium exit unit 54.

Note that, in a case where the controller 70 controls the fixing unit 40, and performs the fixing of the toner having the metal color, an amount of the heat imparted to the toner image may be set to be greater that a case of the toner having another color. Specifically, the controller 70 increases the amount of the heat imparted to the toner image at the time of fixing by controlling the fixing unit 40 to change at least one of the fixing temperature, the fixing pressure, and the fixing time. For example, the amount of heat imparted to the toner image is increased by raising the fixing temperature and the fixing pressure, and extending the fixing time.

Figure 5:
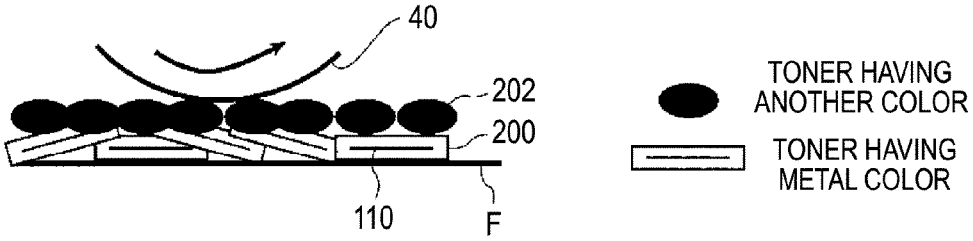
FIG. 5 is a sectional view schematically illustrating a state in which a superimposed toner image is formed and fixed on a recording medium in a normal mode.

With the above-described operation, the toner image having the metal color is formed on the entire back surface of the film F so as to perform baking on the film F, and the toner image having another color is formed on the surface of the film F. Here, in consideration of the fixing step for the toner image having the metal color, the normal mode and the "metal glossiness improving mode (back surface having metal color)" are compared with each other. FIG. 5 is a sectional view illustrating an example of a state in which the superimposed toner image is formed and fixed on the recording medium in the normal mode. In addition, FIGS. 6A to 6C are sectional views illustrating an example of a state in which the toner image is formed and fixed on the film in a case where a back surface having the metal color is selected in the metal glossiness improving mode.

As illustrated in FIG. 5, in the normal mode, a toner 200 having the metal color which contains the flat metal pigment 110 and a toner 202 having another color except for the metal color are superimposed on the film F to which the image is transferred but is not fixed yet. The toner image having the metal color is a so-called a base image, and thus is formed on the lowermost layer. In addition, in order to avoid unevenness caused by the toner image having another color, the toner image having the metal color is formed on the lowermost layer. However, in consideration of the fixing step of the toner image having the metal color, since the toner 202 having another color exists on the upper side of the toner having the metal color 200, a shearing force from the fixing unit 40 is not directly imparted to the toner 200 having the metal color, and thus the orientation of the flat metal pigment 110 is deteriorated.

Figure 6A:
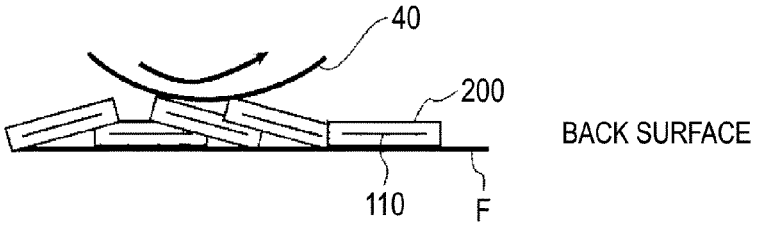
FIGS. 6A, 6B and 6C are sectional views schematically illustrating an example of a state in which a toner image is formed and fixed on the film in a case where a back surface having a metal color is selected in a metal glossiness improving mode.
Figure 6B:
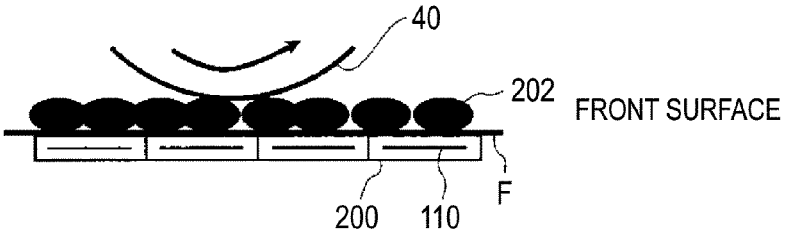
Figure 6C:
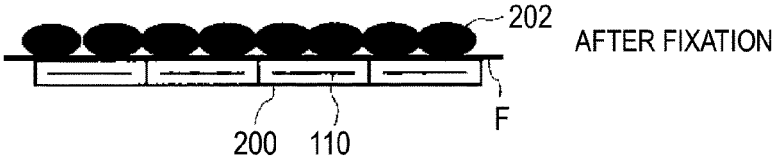

In contrast, in the metal glossiness improving mode (back surface having metal color), as illustrated in FIG. 6A to FIG. 6C, when the toner image having the metal color is fixed on the entire back surface of the film F, the toner 200 having the metal color which contains the flat metal pigment 110 only exists on the film F to which the image is transferred but is not fixed yet, and thus the shearing force from the fixing unit 40 is directly imparted to the toner having the metal color 200 in the transport direction of the film F. With this, the reflecting surface 110A of the flat metal pigment 110 faces the direction orthogonal to the surface of the film F, and the flat metal pigments 110 are arranged in the direction along the surface of the film F. That is, the orientation of the flat metal pigment 110 is improved.

In addition, the film F is transparent, and thus even when the toner image having the metal color is formed on the back surface, the metal glossiness of the image is not damaged. That is, as compared with the case where the toner image having the metal color and the toner image having another color are superimposed on the front surface of the film F, the orientation of the flat metal pigment 110 is improved and thus the metal glossiness is also improved.

Figure 7A:
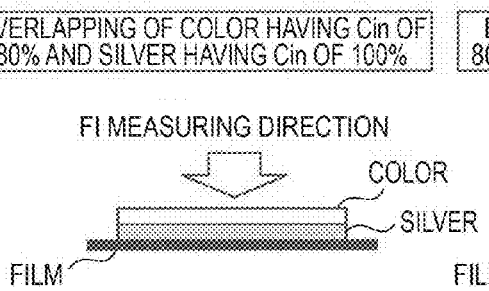
FIGS. 7A and 7B are schematic diagrams illustrating a forming position of the toner image on the film and a measuring direction of a flop index value (FI value)
Figure 7B:
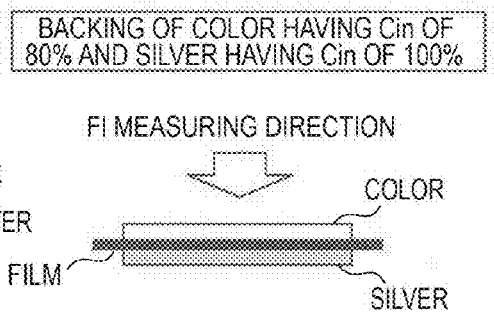

Here, regarding the toner image formed in the normal mode and the toner image formed in the metal glossiness improving mode (back surface having silver color), a flop index value is measured. The flop index value (FI value) means an index indicates the metal glossiness, and as the value thereof is large, the metal glossiness is improved. The FI value is measured based on ASTME 2194. FIGS. 7A and 7B are schematic diagrams illustrating a forming position of the toner image on the film and a measuring direction of the FI value, and FIG. 7C is a graph illustrating a measurement result of the FI value.

In the normal mode, as illustrated in FIG. 7A, the toner image having the silver color and the color toner image having any one of the Y color, M color, and C color are formed to be superimposed on the front surface of the film, and then the FI value is measured from the front surface side of the film. On the other hand, in the metal glossiness improving mode (back surface having metal color), the toner image having the silver color is formed on the back surface of the film so as to perform the backing on the back surface as illustrated in FIG. 7B, and the color toner image having any one of the Y color, the M color, and the C color is formed on the front surface of the film, and then the FI value is measured from the front surface side of the film. In both of the above-described modes, the toner image having the silver color is set as a solid image having an image density Cin of 100%, and the color toner image is set as an image having an image density Cin of 80%.

A modified machine of "COLOR 1000 PRESS" manufactured by Fuji Xerox Co., Ltd. is used as the image forming apparatus, an "OHP film for PPC laser" manufactured by KISO CHEMICAL Co., Ltd. is used as the film, and a matt toner equipped with "COLOR 1000 PRESS" manufactured by Fuji Xerox Co., Ltd. is used as the Y color toner, the M color toner, and the C color toner. The fixing conditions is set such that the fixing rate is 445 [mm/sec] and the fixing temperature is 155° C. A multi-angle colorimeter "BYK-MAC" manufactured by TOYO SEIKI Co., Ltd. is used to measure the FI value.

Figure 7C:
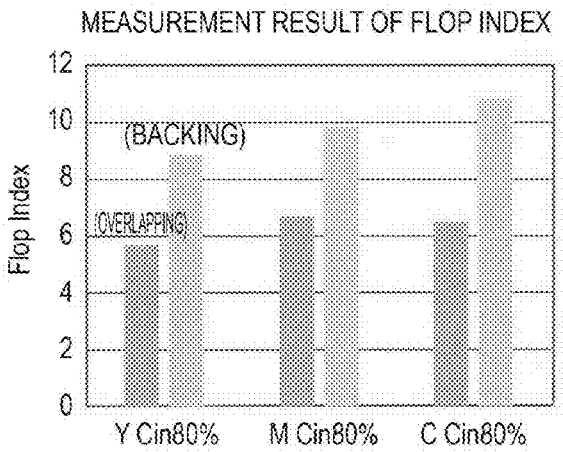
FIG. 7C is a graph illustrating a measurement result of the FI value.

As illustrated in FIG. 7C, in the Y color, the FI value of the toner image formed in the metal glossiness improving mode (backing) is more improved than the FI value of the toner image formed in the normal mode (overlapping) by 1.56 times. In addition, in the M color, the FI value of the toner image formed in the metal glossiness improving mode is more improved than the FI value of the toner image formed in the normal mode by 1.47 times. In addition, in the C color, the FI value of the toner image formed in the metal glossiness improving mode is more improved than the FI value of the toner image formed in the normal mode by 1.67 times. It is found from the above results that as compared with the case where the toner image having the metal color and the toner image having another color are formed to be superimposed on the surface of the film F, the metal glossiness is improved in the case where the toner image having the metal color is formed on the entire back surface of the film F.

Note that, in the above description, the case of receiving the image forming command in "metal glossiness improving mode (back surface having metal color)" is described; however, the "metal glossiness improving mode" has options such as "one surface having a metal color" and "both surfaces having a metal color", in addition to the "back surface having the metal color" in which the toner image having the metal color is formed on the back surface and the toner image having another color is formed on the front surface. In the "one surface having the metal color", the toner image having the metal color is formed the one surface of the film. In the "both surfaces having the metal color", the toner image having the metal color is formed on both sides of the film. Hereinafter, the image forming step of the above cases will be described.

(Metal Glossiness Improving Mode (One Surface Having Metal Color))

Similar to the case of the normal mode, the controller 70 which receives the image forming command in the "metal glossiness improving mode (one surface having the metal color)" operates the toner image forming unit 20, the transfer unit 30, the fixing unit 40, the medium transport unit 50, the post-processing unit 60, and the like.

First, a solid image is formed of the toner having the metal color which is the first spot color (V) on the photoconductor drum 21V. The solid image is formed on the entire image forming region of the one surface of the film F (hereinafter, referred to as "the entire one surface"). The toner image having the metal color formed on the photoconductor drum 21V is transferred to the transfer belt 31 by the primary transfer roller 33V. The toner image having the metal color on the transfer belt 31 is transferred to the one surface of the film F at the transfer nip NT.

Next, the toner image is transferred to and fixed on the one surface of the film F when the film F passes through the fixing nip NF of the fixing unit 40. The film F which is output from the fixing unit 40 is processed by the post-processing unit 60 and then is output to the exit medium receiving portion 541.

Figure 8A:
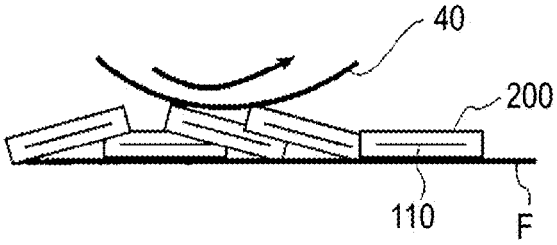
FIGS. 8A and 8B are sectional views schematically illustrating a state in which the toner image is formed and fixed on the film in a case where one surface having the metal color is selected in the metal glossiness improving mode.
Figure 8B:
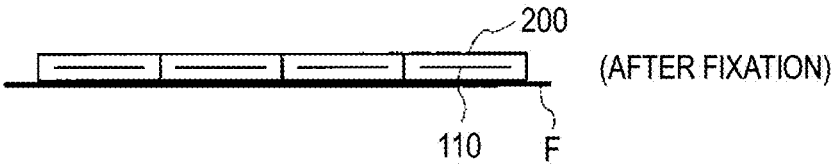

With the above-described operation, the toner image having the metal color is formed on the entire one surface of the film F. FIGS. 8A and 8B are sectional views illustrating a state in which the toner image is formed and fixed on the film in a case where one surface having the metal color is selected in the metal glossiness improving mode. Also in this case, when the toner image having the metal color is fixed on the entire one surface of the film F, the toner 200 having the metal color which contains the flat metal pigment 110 only exists on the film. F to which the image is transferred but is not fixed yet, and the shearing force from the fixing unit 40 is directly imparted to the toner having the metal color 200, and thus the orientation of the flat metal pigment 110 is improved.

In addition, the film F is transparent, and thus even when the toner image having the metal color is formed on the one surface, the metal glossiness of the image is not damaged. That is, as compared with the case where the toner image having the metal color and the toner image having another color are superimposed on the one surface of the film F, the orientation of the flat metal pigment 110 is improved and thus the metal glossiness is also improved.

(Metal Glossiness Improving Mode (Both Surfaces Having the Metal Color))

Similar to the case of the normal mode, the controller 70 which receives the image forming command in the "metal glossiness improving mode (both surfaces having the metal color)" operates the toner image forming unit 20, the transfer unit 30, the fixing unit 40, the medium transport unit 50, the post-processing unit 60, and the like.

First, a solid image is formed of the toner having the metal color which is the first spot color (V) on the photoconductor drum 21V. The solid image is formed on the entire image forming region of the one surface of the film F (hereinafter, referred to as "the entire one surface"). The toner image having the metal color formed on the photoconductor drum 21V is transferred to the transfer belt 31 by the primary transfer roller 33V. The toner image having the metal color on the transfer belt 31 is transferred to the one surface of the film F at the transfer nip NT.

Next, the toner image is transferred to and fixed on the one surface of the film F when the film F passes through the fixing nip NF of the fixing unit 40. The film F which is output from the fixing unit 40 is processed by the post-processing unit 60.

The controller 70 switches a transporting path of the film F after passing through the image inspecting unit 66 of the post-processing unit 60 into the branch path 56P1 of the medium returning unit 56 from the medium exit path 54P of the medium exit unit 54. With this, the film F in which the toner image having the metal color is formed on the entire one surface has the front surface and the back surface reversed to each other via the reverse path 56P, and then is fed into the medium supply path 52P.

Next, a solid image is formed of the toner having the metal color which is the first spot color (V) on the photoconductor drum 21V. The solid image is formed on the entire image forming region of the other one surface of the film F (hereinafter, referred to as "the entirety of the other one surface"). The toner image having the metal color formed on the photoconductor drum 21V is transferred to the transfer belt 31 by the primary transfer roller 33V. The toner image having the metal color on the transfer belt 31 is transferred to the entirety of the other one surface of the film F in which the toner image having the metal color is formed on the one surface.

Next, the toner image having the metal color is transferred to and fixed on the entirety of the other one surface of the film F when the film F passes through the fixing nip NF of the fixing unit 40. The film F which is output from the fixing unit 40 is processed by the post-processing unit 60 and then is output to the external output medium receiving portion 541.

Figure 9A:
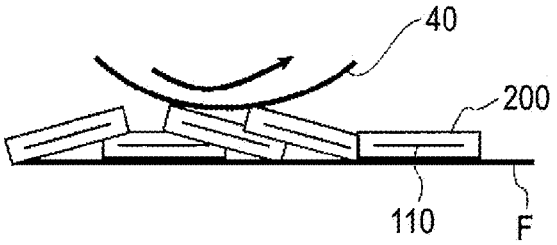
FIGS. 9A, 9B and 9C are sectional views schematically illustrating a state in which the toner image is formed and fixed on the film in a case where both surfaces having the metal color is selected in the metal glossiness improving mode.
Figure 9B:
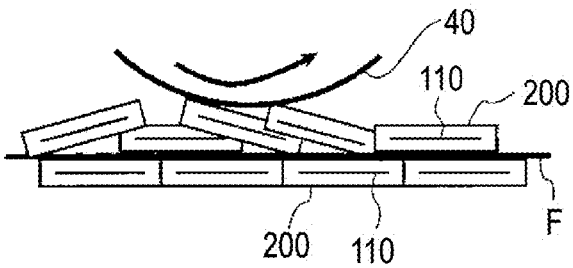
Figure 9C:
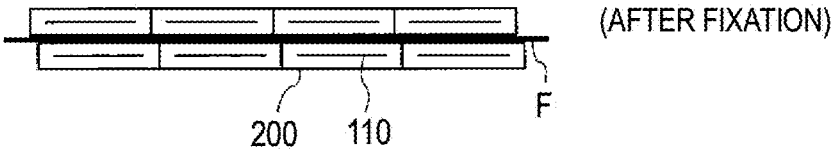

With the above-described operation, the toner image having the metal color is formed on the entire surface of each of the both surface of the film F. FIG. 9A to 9C are sectional views illustrating a state in which the toner image formed on the film is fixed in a case where both surfaces having the metal color is selected in the metal glossiness improving mode. Also in this case, when the toner image having the metal color is fixed on the entire surface of each of the film F, the toner 200 having the metal color which contains the flat metal pigment 110 only exists on the film F to which the image is transferred but is not fixed yet, and the shearing force from the fixing unit 40 is directly imparted to the toner having the metal color 200, and thus the orientation of the flat metal pigment 110 is improved.

That is, as compared with the case where the toner image having the metal color and the toner image having another color are superimposed on the one surface of the film F, the orientation of the flat metal pigment 110 is improved and thus the metal glossiness is also improved. Further, as compared with the case where the toner image having the metal color is formed on only the one surface of the film, the coverage ratio by the flat metal pigments is also improved, and thus the metal glossiness is further improved.

Modification Example

Note that, it is needless to say that the configuration of the image forming apparatus described in the exemplary embodiments is an example, and the configuration may be changed within the scope of the invention without departing the gist thereof.

For example, in the above exemplary embodiment embodiments, an example in which the toner image forming units 20V, 20W, 20Y, 20M, 20C, and 20K of the image forming device 12 are arranged in order of 20W→20Y→20M→20C→20K→20V of the toner image forming units along the upper side portion of the transfer belt 31 from the upstream side in the moving direction of the transfer belt 31 is described, however, the color type and the order are not limited to those in the above exemplary embodiment. For example, the toner image forming unit 20W of the second spot color (W) may be omitted.

Figure 10:
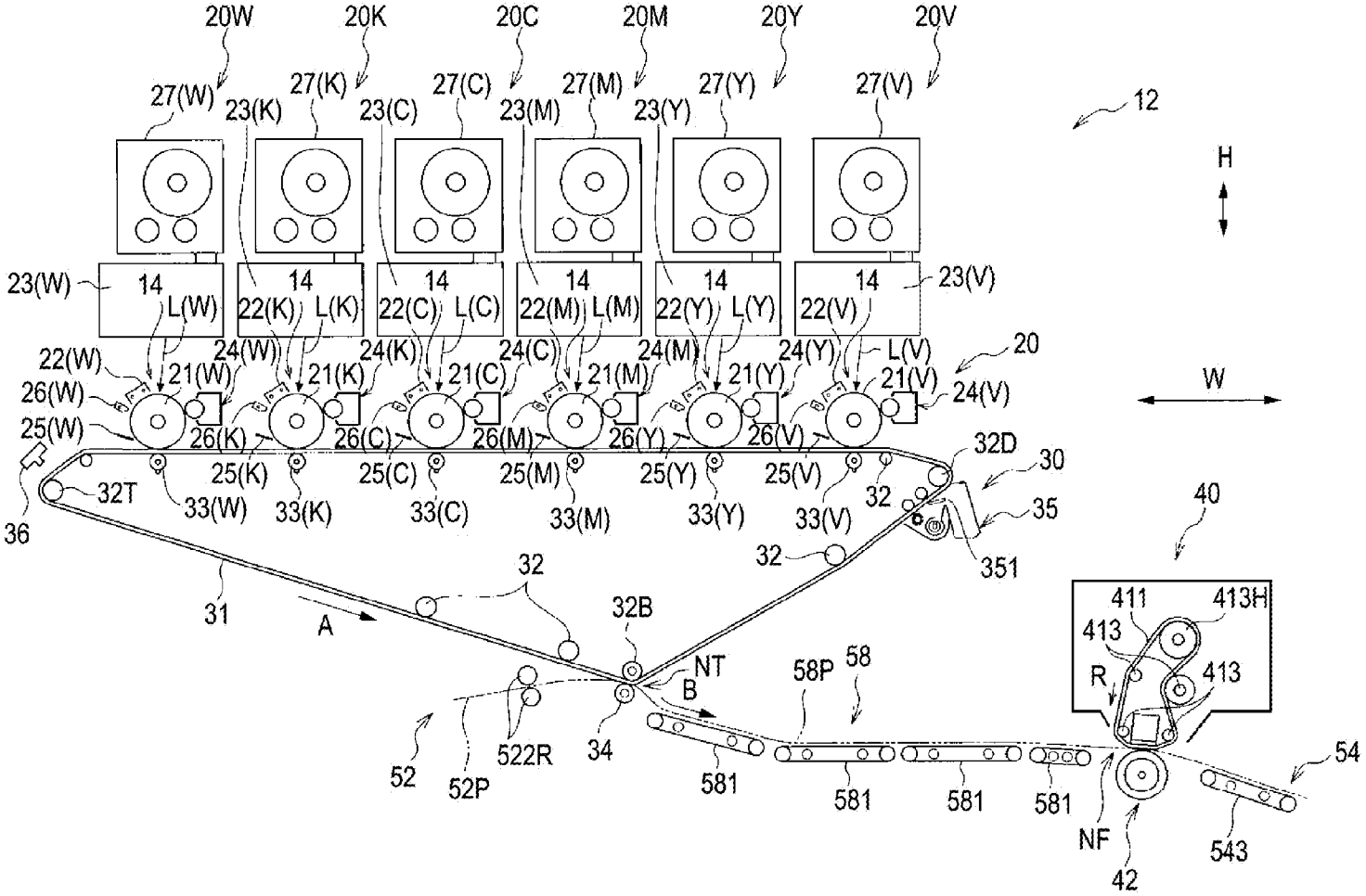
FIG. 10 is a schematic configuration diagram illustrating a modification example of the configuration of the image forming device.
Figure 11:
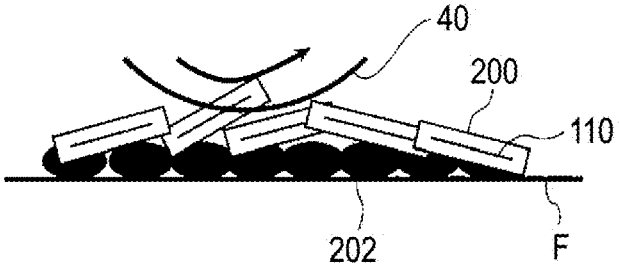
FIG. 11 is a sectional view schematically illustrating a state in which a superimposed toner image is formed and fixed on the recording medium by the image forming device of the modification example in the normal mode.

In addition, for example, the order of the toner image forming units may be changed such that the toner image forming units are arranged in order of 20V→20Y→20M→20C→20K→20W from the upstream side in the moving direction of the transfer belt 31 as illustrated in FIG. 10. In this case, as illustrated in FIG. 11, in the normal mode, the toner 202 having another color except for the metal color exists under the toner 200 having the metal color which contains the flat metal pigment 110 on the film F to which the image is transferred but is not fixed yet. For this reason, the unevenness caused by the toner image having another color cannot be avoided, and thus the orientation of the flat metal pigment 110 is deteriorated. However, when the metal glossiness improving mode is selected, the toner 200 having the metal color which contains the flat metal pigment 110 only exists on the film F to which the image is transferred but is not fixed yet, and thus regardless of the order of arrangement of plural toner image forming units 20, the orientation of the flat metal pigment 110 is improved, and thus the metal glossiness is also improved.

In addition, in the above exemplary embodiment, an example in which the "normal mode" or the "metal glossiness improving mode" is selected for each film, and any one of the "back surface having the metal color", the "one surface having the metal color", and the "both surfaces having the metal color" is selected for each film F is described; however, the mode setting is not necessarily performed based on a film unit. The "normal mode" or the "metal glossiness improving mode" may be selected for each region, and any one of the "back surface having the metal color", the "one surface having the metal color", and the "both surfaces having the metal color" may be selected for each region by dividing one film into plural regions. For example, a region in which the toner image having another color is formed only on the front surface, a region in which the toner image having another color is formed on the front surface and the toner image having the metal color is formed on the back surface, and a region in which the toner image having the metal color is formed on both surfaces may be mixed on the same film.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that comprises a developing device which performs development with a toner having a metal color and containing a flat metal pigment and a developing device which performs development with a toner having another color other than the metal color and not containing a flat metal pigment, and forms a toner image on a recording medium;

a fixing unit that fixes the toner image formed on the recording medium; and a controller that controls the image forming unit and the fixing unit such that a toner image is formed of the toner having the metal color and fixed directly on one surface of a transparent film, and controls transport of the transparent film such that the transparent film on which the toner image formed of the toner having the metal color that is fixed directly on the one surface is turned front to back and the turned film is supplied to the image forming unit, in a case where the transparent film is selected as the recording medium and a metal glossiness improving mode is selected so as to improve metal glossiness, the metal glossiness improving mode being selectable in response to the transparent film being selected as the recording medium.

2. The image forming apparatus according to claim 1, wherein the controller controls the image forming unit and the fixing unit such that the transparent film on which the toner image formed of the toner having the metal color that is fixed directly on the one surface is supplied to the image forming unit, and another toner image is formed of the toner having the metal color and is fixed on another surface of the supplied film.

3. The image forming apparatus according to claim 2, wherein in a case where the fixing unit fixes the toner images formed of the toner having the metal color, the controller controls an amount of heat imparted to the toner images formed of the toner having the metal color to be greater than an amount of heat in a case of fixing a toner image formed of the toner having another color.

4. The image forming apparatus according to claim 3, wherein in a case where the image forming unit forms the toner images having the metal color, the controller controls the image forming unit to form the toner images having the metal color as solid images having image densities of 100%.

5. The image forming apparatus according to claim 2, wherein in a case where the image forming unit forms the toner images having the metal color, the controller controls the image forming unit to form the toner images having the metal color as solid images having a image density densities of 100%.

6. The image forming apparatus according to claim 1, wherein the controller controls the image forming unit and the fixing unit such that the transparent film on which the toner image formed of the toner having the metal color that is fixed directly on the one surface is supplied to the image forming unit, and a toner image is formed of the toner having another color and is fixed on another surface of the supplied film.

7. The image forming apparatus according to claim 6, wherein in a case where the fixing unit fixes the toner image formed of the toner having the metal color, the controller controls an amount of heat imparted to the toner image formed of the toner having the metal color to be greater than an amount of heat in a case of fixing the toner image formed of the toner having another color.

8. The image forming apparatus according to claim 7, wherein in a case where the image forming unit forms the toner image having the metal color, the controller controls the image forming unit to form the toner image having the metal color as a solid image having an image density of 100%.

9. The image forming apparatus according to claim 6, wherein in a case where the image forming unit forms the toner image having the metal color, the controller controls the image forming unit to form the toner image having the metal color as a solid image having an image density of 100%.

10. The image forming apparatus according to claim 1, wherein in a case where the fixing unit fixes the toner image formed of the toner having the metal color, the controller controls an amount of heat imparted to the toner image formed of the toner having the metal color to be greater than an amount of heat in a case of fixing a toner image formed of the toner having another color.

11. The image forming apparatus according to claim 10, wherein in a case where the image forming unit forms the toner image having the metal color, the controller controls the image forming unit to form the toner image having the metal color as a solid image having an image density of 100%.

12. The image forming apparatus according to claim 1, wherein in a case where the image forming unit forms the toner image having the metal color, the controller controls the image forming unit to form the toner image having the metal color as a solid image having an image density of 100%.

13. The image forming apparatus according to claim 1, further comprising an intermediate transfer belt that circulates to transport the recording medium; and a medium supply unit that supplies the recording medium to the intermediate transfer belt, and the developing device which performs development with the toner having the metal color and containing the flat metal pigment is provided between the developing device which performs development with the toner having another color other than the metal color and not containing a flat metal pigment and the medium supply unit in a direction of rotation of the intermediate transfer belt.

14. The image forming apparatus according to claim 1, wherein in a case in which a normal mode is selected, the fixing by the fixing unit is conducted after a toner image formed of the toner having the metal color and a toner image formed of the toner having another color other than the metal color are superimposed onto one surface of a recording medium, and in a case in which the metal glossiness improving mode is selected, the toner image formed of the toner having the metal color is fixed directly onto the one surface of the transparent film and a toner image formed of the toner having another color other than the metal color is fixed onto another surface of the transparent film.

* * * * *